United States Patent [19]

Tsai et al.

[11] Patent Number: 5,035,635

[45] Date of Patent: Jul. 30, 1991

[54] REVOLVING SAFETY SOCKET

[76] Inventors: Shiang-shiun Tsai; Ming-jeng Tsai; Meei-lin Tsai, all of 293 Pei Tun Road, all of Taichung, Taiwan

[21] Appl. No.: 578,873

[22] Filed: Sep. 4, 1990

[51] Int. Cl.[5] ..... H01R 29/00; H01R 13/44

[52] U.S. Cl. ..... 439/188; 439/140; 439/338

[58] Field of Search ..... 439/188, 137, 131, 146, 439/140, 338, 372, 911

[56] References Cited

U.S. PATENT DOCUMENTS

| | | | |
|---|---|---|---|
| 1,593,985 | 7/1926 | Nelsen | 439/338 |
| 4,461,523 | 7/1984 | Ustin et al. | 439/139 |
| 4,927,373 | 5/1990 | Dickie | 439/188 |
| 4,932,886 | 6/1990 | Glaser | 439/188 |
| 4,969,836 | 11/1990 | Magnier et al. | 439/188 |

FOREIGN PATENT DOCUMENTS

| | | | |
|---|---|---|---|
| 2385235 | 10/1978 | France | 439/338 |

*Primary Examiner*—Paula A. Bradley

[57] ABSTRACT

A revolving safety socket of the present invention has a uniquely-designed stand, which serves as a switching device. It consists mainly of a circular hole in the case cover and a circular recess in the case base. Located between the circular hole and the circular recess is a revolving stand having receptacles therein. When the socket is not in use, the conductive member of the revolving stand is not in contact with the copper clip which is connected to the power supply. Only when a plug is inserted into the revolving stand, which is then rotated for a 90-degree angle, would the conductive member become engaged with the copper clip to permit the power supply to be on. Additionally, the socket has the reversed L-shaped fasteners to hold the protruded block of the plug firmly in place, ensuring that the plug can not be accidentally pulled out of the socket.

5 Claims, 5 Drawing Sheets

REVOLVING SAFETY SOCKET

BACKGROUND OF THE PRESENT INVENTION

The present invention relates to an electrical socket, and particularly to an electrical socket of the type having a revolving safety device to ensure an uninterrupted power supply and to prevent the children from being electrocuted accidentally.

The ubiquitous conventional sockets, though in use for nearly one hundred years, have shortcomings described below.

1. Most wall sockets are located at lower portion of the wall, permitting easy access to the children who might playfully insert something of conductive nature into the plug receptacles of the sockets, resulting in an accidental electrocution of the children.

2. The socket and the plug can become disengaged easily and accidentally, causing the interruption of the power supply and the obstruction of normal operation of office equipments such as computers.

3. As a result of a prolonged usage of the socket, the flexible conductive member installed inside the receptacle to serve as a fastening device is susceptible to fatigue, resulting in a poor contact between the receptacle and the plug.

The present invention is intended to overcome the problems mentioned above.

SUMMARY OF THE PRESENT INVENTION

The present invention has identified the main culprits responsible for the shortcomings of a conventional socket. The way that a conductive member installed inside the receptacle is responsible for the conduction of the power flow and is not properly concealed is a poor design. Furthermore, the engagement between the socket and the plug by means of a conductive member is not desirable.

The primary objective of the present invention is to provide a revolving safety socket, which must be rotated for an angle of 90 degrees in order to have a conductive capacity. On the other hand, the socket would have to be rotated on a reverse direction for 90 degrees in order to allow the plug to be disengaged with the socket. In other words, the socket will in no way conduct the power flow when it is not in use.

Another objective of the present invention is to provide a revolving safety socket which must be rotated for 90 degrees, after the introduction of the plug, in order to allow the fastener of the socket to catch and hold the protruded block of the plug, resulting in a secure engagement of the plug with the socket.

BRIEF DESCRIPTION OF THE DRAWINGS

The objectives and the features of the present invention will become more apparent with reference to the following description taken in conjunction with the accompanying drawings, wherein the reference numerals denote the like parts, and in which.

DESCRIPTION OF THE PREFERRED EMBODIMENT

Figure 1:
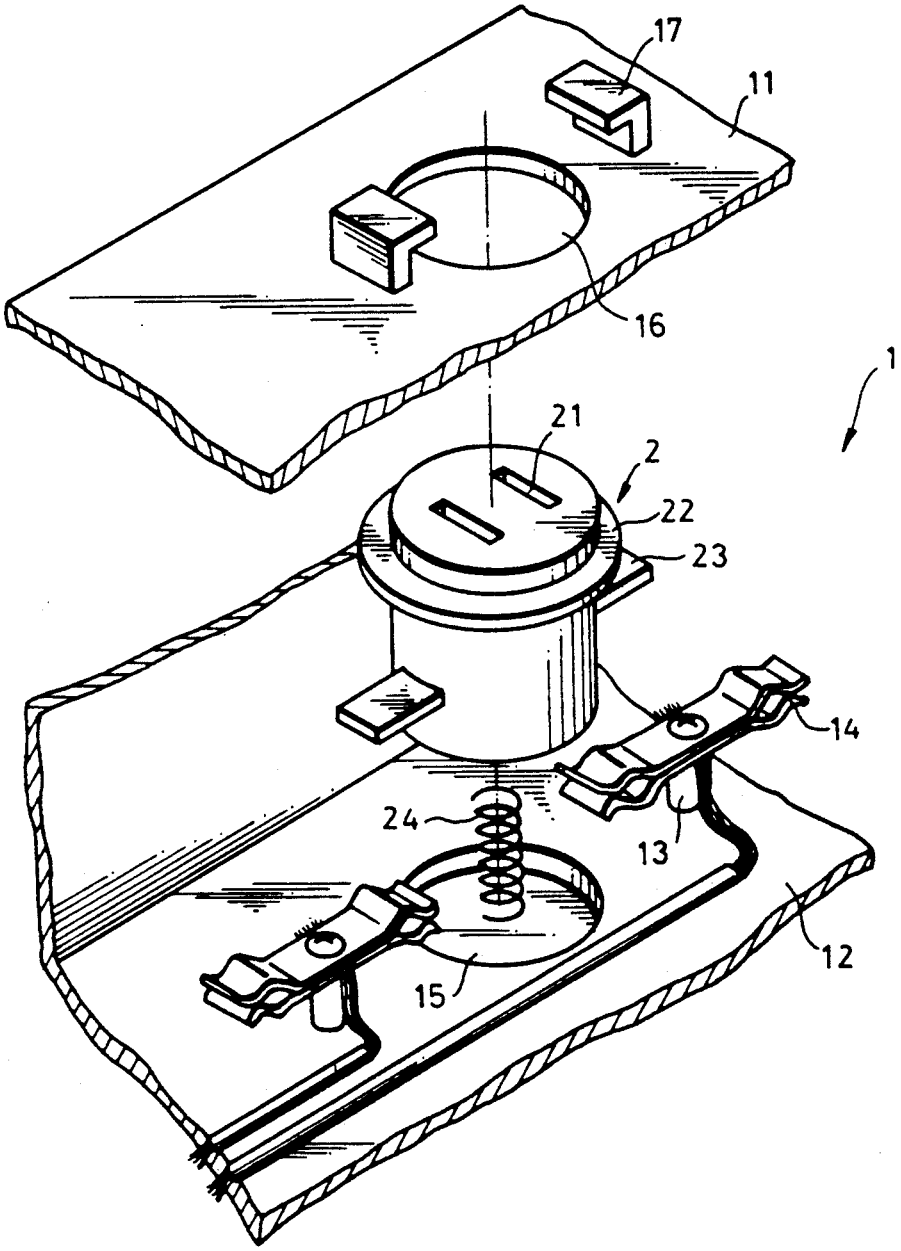
FIG. 1 is a three-dimensional view of the embodiment of the present invention, showing its disassembled parts.
Figure 3:
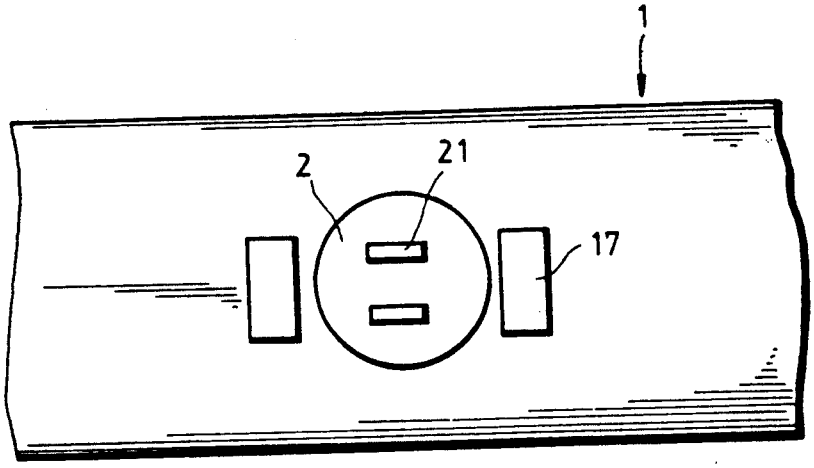
FIG. 3 is a plane view of the revolving stand according to the present invention.

Referring to FIG. 1, the embodiment of the present invention consists mainly of a socket 1 which has a circular revolving stand 2 capable of making a 90-degree rotation, receptacles 21 to receive arms of a plug 3, and fasteners 17 to hold the plug 3 securely in place. The socket 1, either a wall type or a mobile type with an extension cord attached thereto, is a case structure comprising a case cover 11 and a case base 12. The case cover 11 has one or several circular hole 16. Situated at the opposite locations adjacent to the circular hole 16 are two reversed L-shaped fasteners 17. The case base 12 has a circular recess 15 located coaxially with the circular hole 16 of the case cover 11. At the opposite side of the circular recess 15 are a pair of set columns 13, each of which has an electro-conductive copper clip 14 attached thereto.

Figure 2:
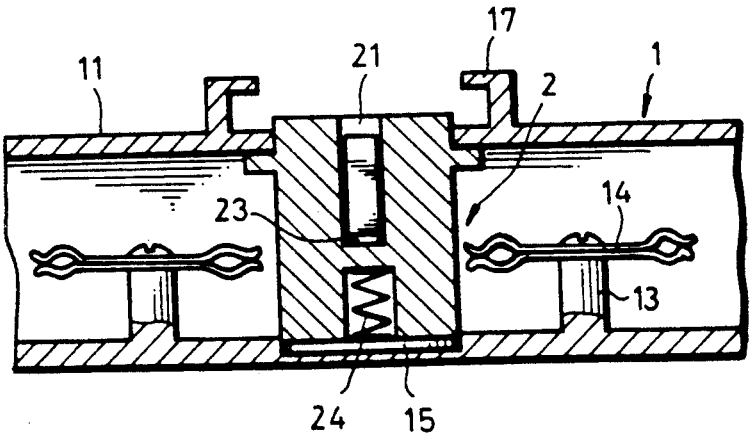
FIG. 2 is a cut-away view of the embodiment according to the present invention.
Figure 4:
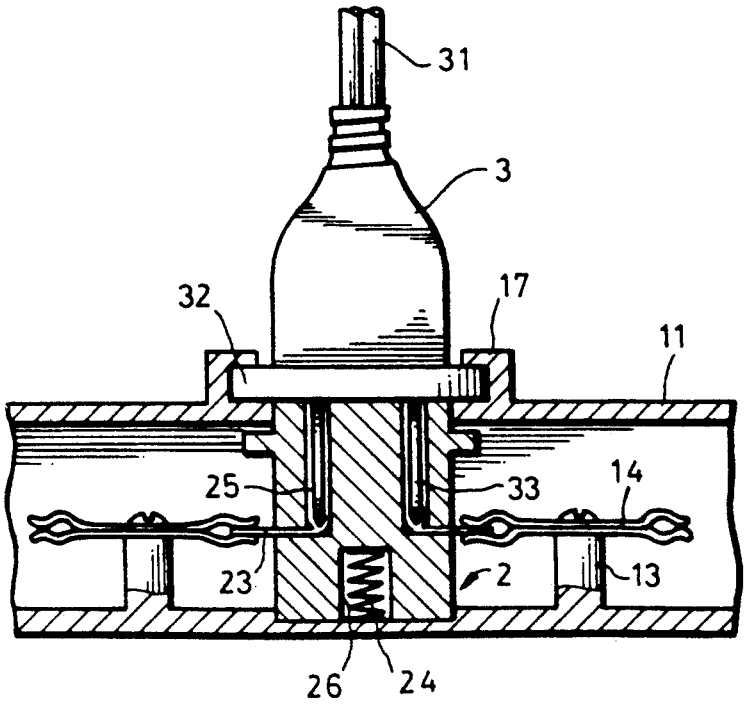
FIG. 4 is a cut-away view of the embodiment of the present invention, in which a plug is engaged with a socket.

Now referring to FIGS. 1 and 2, there are two receptacles 21 located in the upper end portion of the revolving stand 2, a column structure. As shown in FIG. 4, within each of the receptacles 21 is a conductive clip 25 serving as a coupling device to receive the plug arm 33 of the plug 3. The conductive clip 25 located inside the revolving stand 2 extends itself outward in opposite directions to form the conductive members 23. Just below the upper end portion of the revolving stand 2 is a flange 22. Located at the base of the revolving stand 2 is a blind hole 26 to receive a spring 24.

Referring to FIGS. 1 and 2 again, since the revolving stand 2 is placed between the circular hole 16 of the case cover 11 and the circular recess 15 of the case base 12, the tension generated by the spring 24 is forced upon the case base 12 and the revolving stand 2. The flange 22 of the revolving stand 2 serves to prevent the revolving stand 2 from being forced out. When the socket 1 is not in use, the conductive member 23 is not in contact with the copper clip 14 which is connected to the power supply. Therefore, even if a child inserts something of conductive nature into the exposed receptacles 21, there is absolutely no danger of possible electrocution.

Figure 5:
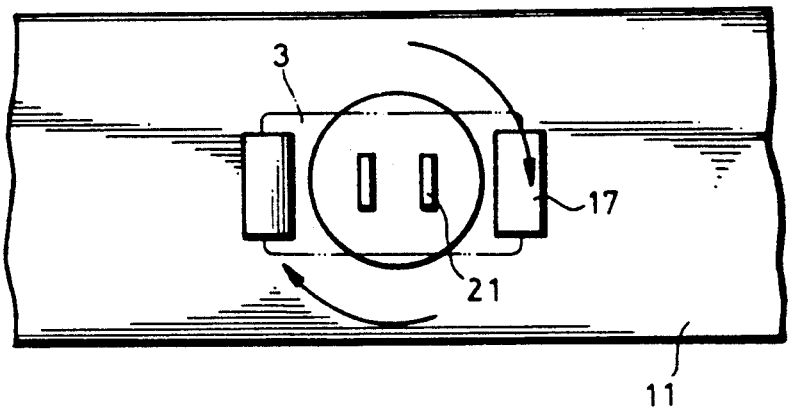
FIG. 5 is a plane view of the rotating stand of the present invention, showing the angle of rotation.
Figure 7:
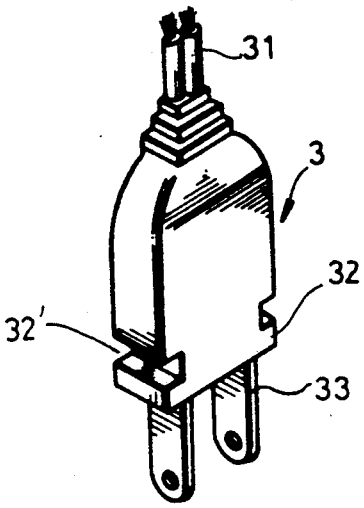
FIG. 7 shows a plug having groove according to the present invention.
Figure 8:
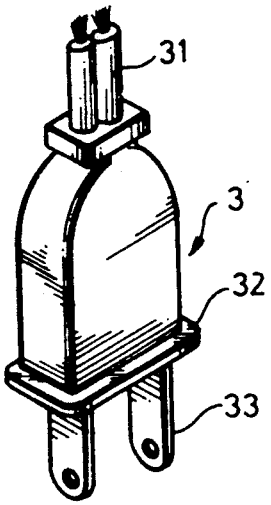
FIG. 8 shows a plug having protruded block according to the present invention.

FIGS. 4, 7 and 8 show the structure of a plug 3 embodying the concepts of the present invention. Accordingly, the plug 3 generally comprises a casing including wire 31 disposed on its top connecting to an electric appliance, protruded block 32 being either disposed on its bottom periphery, as shown in FIG. 8, or formed by groove 32' transversely recessing both its lower sides adjacent to its bottom thereof, as shown in FIG. 7. Extending longtitudinally downwards from the bottom of the casing to terminate two plug arms 33, are parallel to each other and corresponding to the receptacles 21. Referring to FIGS. 4 and 5, when a plug 3 is inserted into the receptacles 21 of the revolving stand 2, the plug arms 33 of the plug 3 are coupled with the conductive clip 25. Therefore, the revolving stand 2 will rotate in turn for a 90-degree angle if the plug 3 is pressed and rotated likewise. As a result, the conductive members 23 will become engaged with the copper clips 14 which are connected with the power supply. Additionally, as a result of a 90-degree rotation of the plug 3, the protruded block 32 of the plug 3 is held securely in place by the fastener 17, ensuring that the plug 3 or its wire 31 is not pulled out of the socket 1 accidentally. When the plug 3 is to be pulled out intentionally, it must be pressed and rotated for a 90-degree angle, resulting in disengagement of the conductive members 23 with the copper clips 14 and of the protruded block 32 of the plug 3 with the fastener 17.

It must be pointed out here that the primary function of the spring 24 is to adjust the position level of the conductive member 23, as shown in FIGS. 2 and 4.

Figure 6:
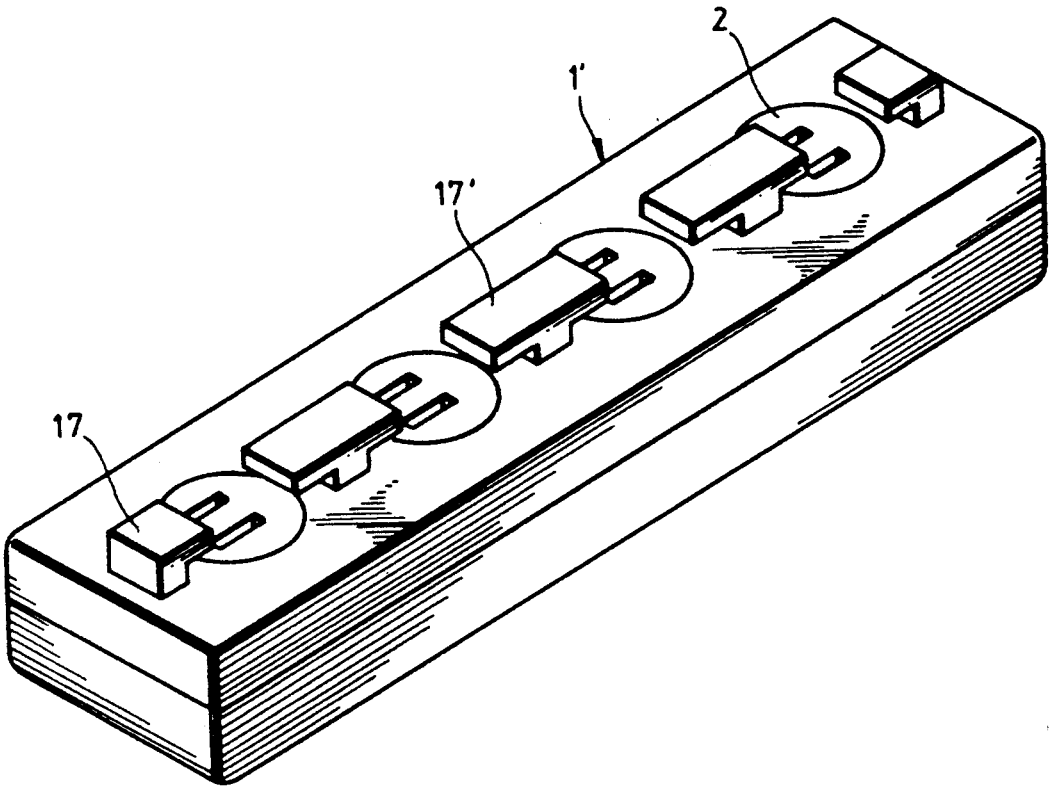
FIG. 6 shows a compound socket according to the present invention.
Figure 9:
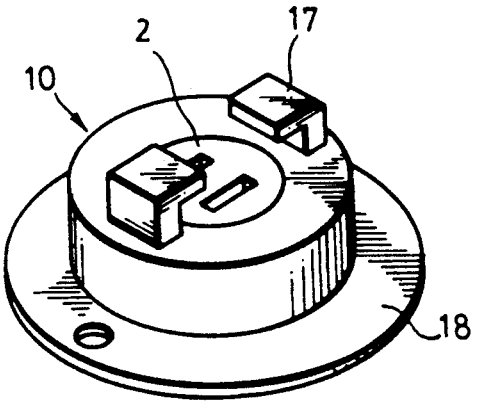
FIG. 9 shows a simple socket having only one revolving stand according to the present invention.

Now referring to FIG. 6, a compound socket 1' has a plurality of revolving stands 2 and dual-direction fasteners 17'. Each dual-direction fastener 17' is located between two revolving stands 2 to engage with the protruded block 32 of the plug 3. The plug 3 shown in FIG. 7 has groove 32' adjacent to the plug arm 33, while the plug 3 shown in FIG. 8 has protruded block 32 similar to the one mentioned previously. The function of the groove 32' is to receive and to engage with dual-direction fastener 17' or the fastener 17. The simple socket 10, as shown in FIG. 9, has only one revolving stand 2 and a set block 18 attached thereto.

The advantages of this embodiment include the structural simplicity, ease of use, and the reliable safety features, all of which have neither been discussed in any published literature nor made available in the market place.

I claim:

1. A revolving safety socket, either a wall type or a mobile type with an extension cord attached thereto, comprising:

a socket having a case body structure with a case cover and a case base; said case cover having a circular hole with two reversed L-shaped fasteners located oppositely thereby; said case base having a circular recess with two set columns formed thereby at opposite location; said set columns having electro-conductive copper clips attached thereto; said circular recess and said circular hole being located coaxially with the revolving stand; and a revolving stand of cylindrical structure having receptacles formed therein, a flange formed around upper end portion thereof, and a blind hole formed in the base thereof to receive a spring; said receptacles having conductive clips formed therein, which extends outwards horizontally in an opposite direction to form conductive members, whereby upon insertion of a plug into the socket, the revolving stand rotates 90° such that the conductive members of the receptacles engage the copper clips of the columns to establish an electrical connection.

2. A revolving safety socket of claim 1, wherein said socket being a compound socket having a plurality of T-shaped fasteners.

3. A revolving safety socket of claim 1, wherein said plug having a protruded block capable of being held securely in place by the fastener.

4. A revolving safety socket of claim 1, wherein said socket being a simple socket whose base having a set block attached thereto to serve as an anchoring means.

5. A revolving safety socket of claim 1, wherein said plug having a groove formed contiguously to plug arms, said groove serving to lock in the fastener firmly.

* * * * *